US006130618A

United States Patent [19]

Burnett et al.

[11] Patent Number: 6,130,618

[45] Date of Patent: Oct. 10, 2000

[54] PIEZOELECTRIC TRANSDUCER ASSEMBLY ADAPTED FOR ENHANCED FUNCTIONALITY

[75] Inventors: George A. Burnett, Amo; Brian S. Bush, Indianapolis, both of Ind.

[73] Assignee: Yosemite Investment, Inc., Indianapolis, Ind.

[21] Appl. No.: 09/007,596

[22] Filed: Jan. 15, 1998

[51] Int. Cl.[7] ..... G08B 5/22; G08B 3/10

[52] U.S. Cl. ..... 340/815.45; 340/384.6; 340/396.1; 340/391.1

[58] Field of Search ..... 340/815.45, 815.49, 340/815.69–815.71, 384.6, 384.1, 384.7, 391.1, 396.1, 474, 326, 330

[56] References Cited

U.S. PATENT DOCUMENTS

| | | | |
|---|---|---|---|
| 3,815,129 | 6/1974 | Sweany | 340/384.6 |
| 3,879,726 | 4/1975 | Sweany | 340/384.6 |
| 4,139,842 | 2/1979 | Fujita et al. | 340/384.6 |
| 4,282,520 | 8/1981 | Shipp et al. | 340/629 |
| 4,325,060 | 4/1982 | Purtell et al. | 340/384.6 |
| 4,374,377 | 2/1983 | Saito et al. | 340/384.6 |
| 4,486,742 | 12/1984 | Kudo et al. | 340/384.6 |
| 4,669,424 | 6/1987 | Bianco et al. | 119/156 |
| 4,811,816 | 3/1989 | Lin | 381/159 |
| 4,820,935 | 4/1989 | Gontowski | 307/112 |
| 5,398,024 | 3/1995 | Knowles | 340/384.6 |
| 5,475,368 | 12/1995 | Collins | 340/391.1 |

FOREIGN PATENT DOCUMENTS

| | | |
|---|---|---|
| 2544-530 | 10/1984 | France . |
| 2736-089 | 2/1978 | Germany . |
| 61-90600 | 5/1986 | Japan . |
| 3-296098 | 12/1991 | Japan . |

*Primary Examiner*—Donnie L. Crosland
*Attorney, Agent, or Firm*—Niro, Seavone, Haller & Niro

[57] ABSTRACT

A novel modular audible signaling device is provided capable of expanded functionality, such as the provision of visual signaling as well. A piezoelectric transducer audible alarm signaling device is provided with an assembly having a housing defining an interior holding a piezoelectric transducer, the housing having a first exterior portion for attachment to a surface and a second exterior portion extending beyond the surface, wherein the first exterior portion and the second exterior portion comprise at least one pair of communicating apertures whereby an electrical conductor may extend through the at least one pair of apertures to the surface. In another aspect, a piezoelectric transducer assembly is provided having a housing defining an interior and a surface, the housing holding a piezoelectric transducer, wherein the housing further comprises an illumination element associated the surface thereof, the illumination element having one or more conductors which extend through the interior of the housing, whereby the illumination element may be electrically inserted into the same electrical circuit as the piezoelectric transducer.

8 Claims, 2 Drawing Sheets

PIEZOELECTRIC TRANSDUCER ASSEMBLY ADAPTED FOR ENHANCED FUNCTIONALITY

FIELD OF THE INVENTION

The present invention relates to audible and visual alarm devices, and more specifically to the field of piezoelectric transducer audible and visual alarm devices.

BACKGROUND OF THE INVENTION

U.S. Pat. No. 3,815,129, issued to Sweany and hereby incorporated by reference, discloses an exemplary feedback type piezoelectric transducer. Piezoelectric transducers, such as those disclosed in the '129 patent, are typically disposed within a housing constructed to maximize transmission of sound into the ambient medium. As shown in FIGS. 1, 2 and 5 of the '129 patent, such transducers have a piezoelectric element mechanically coupled to a substrate, such as a brass disc. The piezoelectric element includes a piezoelectric crystal. The element also has electrode means carried on the crystal or the substrate. The electrode means are electrically connected to electrical terminals. In the '129 patent, these terminals are labeled $T_1$, $T_2$ and $T_3$. $T_1$ and $T_2$ are driving terminals for receiving oscillating driving potentials, and $T_3$ is a feedback terminal that allows the transducer itself to cooperate with an electrical circuit as a reactive impedance. $T_2$ is connected to the electrode means located on the substrate opposite $T_1$ and $T_3$, a brass plate that forms a disc and acts as a diaphragm.

In typical use, all of the above parts are completely enclosed in a housing. The transducer is sealed with a silicon type of material between the brass side of the transducer and the nodal ring that defines the inner surface of the housing. The respective terminals extend outside the housing on one end. The end from which the terminals extend is attached onto a PC board, with the terminals attached to appropriate contacts via a solder connection. The PC board contains the components of the electrical circuit that, like in FIGS. 3 and 4 of the '129 disclosure, enable the noise making device to function.

Heretofore, it was not known to make any electrical connection extending outwardly from the PC board through the transducer housing and to the end of the housing opposite the PC board. Once the housing holding the transducer elements was attached to the PC board, electrical access to any electrical contacts on the PC board was extremely difficult to achieve. The transducer housing took up most of the surface of the PC board and blocked the way. This caused many disadvantages. Among the disadvantages, it was difficult to expand the circuit to include other electrical components that are not necessary to the sound generating function. This made it nearly impossible to add such electrical components to enhance the functionality of the noise making unit, such as light emitting devices or other actuator components. It was also unfeasible to dispose existing or new electrical components on the surface of the transducer housing. While placing such electrical components on the surface of the transducer housing was possible in principle, to do so would formerly require snaking a conductor such as a flying lead wire around the surface of the housing. This approach risks breakages and open circuits. Such an approach also would be expensive to manufacture. Furthermore, a problem to be overcome was how to extend an electrical contact to the PC board through the tight spaces inside the transducer housing without attenuating or degenerating the sound quality emitted by the brass disc diaphragm.

SUMMARY OF THE INVENTION

The present invention overcomes these disadvantages, problems and limitations. In the novel assembly of the present invention, the assembly has a housing defining an interior holding a piezoelectric transducer, the housing having a first exterior portion for attachment to a surface and a second exterior portion extending beyond the surface, wherein the first exterior portion and the second exterior portion comprise at least one pair of communicating apertures whereby an electrical conductor may extend through the at least one pair of apertures to the surface.

In another aspect, the present invention comprises a piezoelectric transducer assembly having a housing defining an interior and a surface, the housing holding a piezoelectric transducer, wherein the housing further comprises an illumination element associated the surface thereof, the illumination element having one or more conductors which extend through the interior of the housing, whereby the illumination element may be electrically inserted into the same electrical circuit as the piezoelectric transducer.

DETAILED DESCRIPTION

Figure 1:
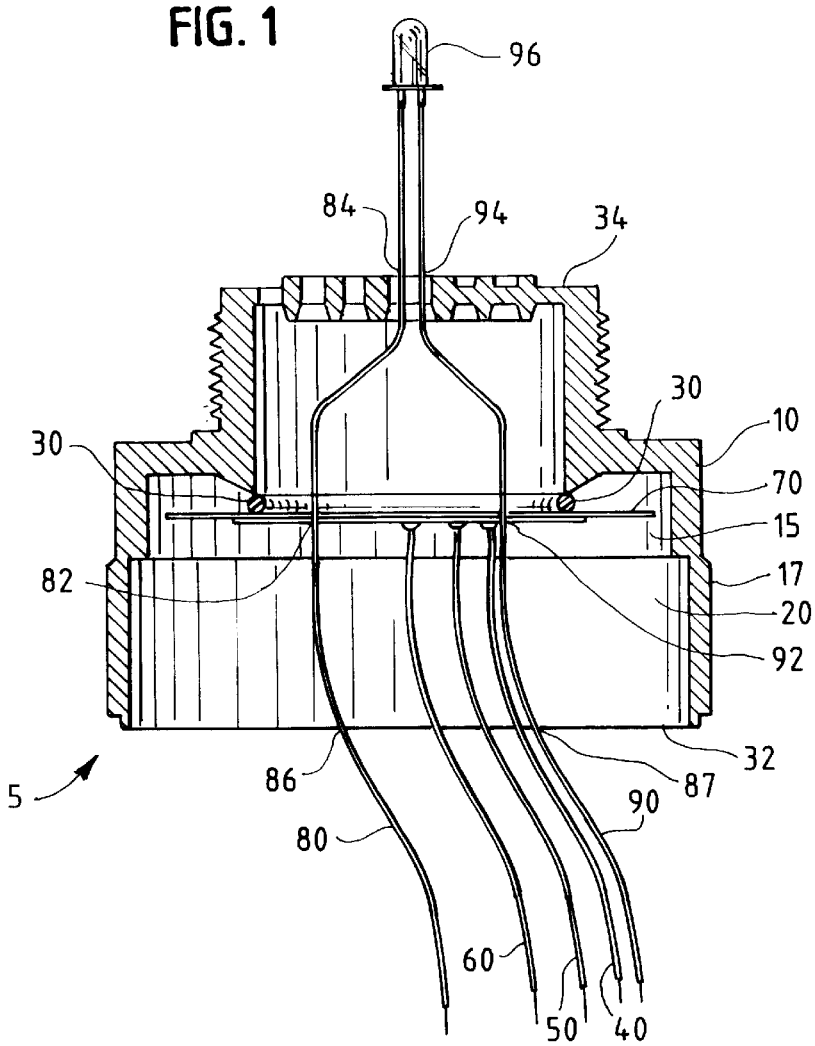
FIG. 1 shows a side cut away cross section of the inside of the transducer assembly of a preferred embodiment of the present invention.

Turning to FIG. 1, in one embodiment, the assembly 5 has a housing 10 that includes an interior 15 and a surface 17. The interior 15 of the housing 10 contains a piezoelectric transducer 70 as described in the Sweany '129 patent, particularly FIG. 5. The transducer 70 is connected to the interior surface of housing 10 with a room temperature vulcanized silicon bead 30 as shown. The surface 17 of housing 10 has a first exterior portion 32 that is on the end of the assembly designed for attachment to a PC board. Surface 17 also has a second exterior portion 34 that, in the preferred embodiment, is located opposite to the first exterior portion 32. Along surface 17 near the second exterior portion 34 are a number of threads. This is so that the final assembly, along with any object to which it is attached, may be snugly secured to a matching set of threads, such as a threaded nut or any other threaded opening. In the case of a threaded opening in an otherwise solid object, the bulk of the assembly 5 and anything to which it is attached may remain hidden, with only second exterior portion 34 showing through.

Figure 2:
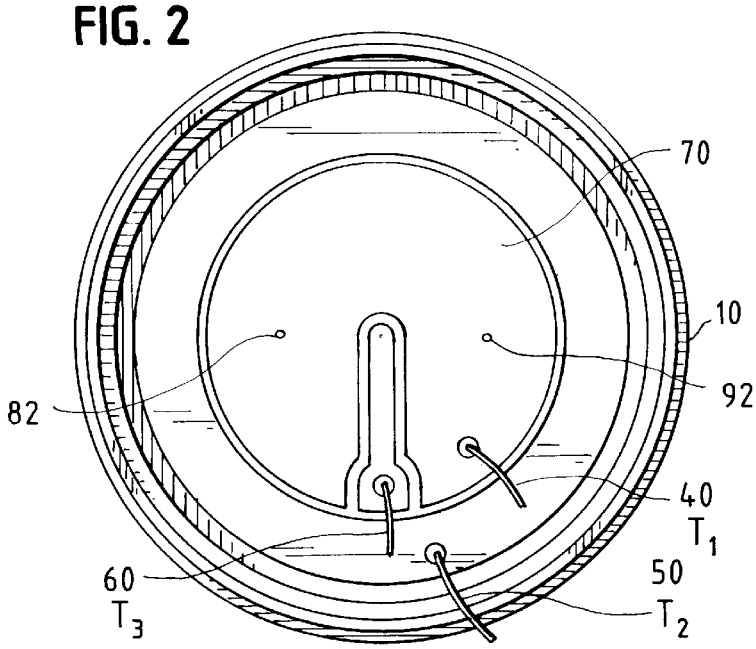
FIG. 2 shows the inside of the transducer assembly of FIG. 1, but from above.

In typical use, the Terminals 40, 50 and 60 correspond respectively to terminals $T_1$, $T_2$ and $T_3$ of the '129 patent. Terminals 40, 50 and 60 extend from transducer 70 through first exterior portion 32 via block 20 which contains (not shown) a printed wiring board and ordinary potted material for sealing the housing. FIG. 2 illustrates the placement of the terminals 40, 50 and 60 on transducer 70 inside the interior 15 of transducer assembly 5. As shown in both FIGS. 1 and 2, a pair of holes, or apertures, 82 and 92 are placed through transducer 70. Their placement is roughly symmetrical around the center, and empirically chosen so that attenuation of the sound quality emitted from the brass diaphragm is minimized. Ideally, such placement will be on nodes of the fundamental frequency of vibrations on the brass disc. Aperture 82 cooperates with apertures 84 and 86 to allow conductor 80 to extend through all of them to reach from first external portion 32 through interior 15 and transducer 70 outward through second external portion 84. Likewise, aperture 92 cooperates with apertures 94 and 87 to allow conductor 90 to extend through all of them to reach from first external portion 32 through interior 15 and transducer 70 outward through second external portion 94. Where conductors 80 and 90 extend outwardly from the second external portion 34, conductors 80 and 90 are connected to a light emitting diode, or LED 96. In this way, when assembly 5 is attached to an appropriate PC board (not shown), the ends of conductors 80 and 90 that extend from first external portion 32 are connected to the rest of the electrical circuit (not shown) in a manner that the driving of transducer 70 through its terminals 40, 50 and 60 simultaneously drives LED 96 in its forward biased mode. In the preferred embodiment, LED 96 is of the self-blinking variety. But constantly emitting LED's may be used with equal effectiveness.

It will be appreciated that in the preferred embodiment, construction of assembly 5 must occur in the proper sequence. This requires that apertures 82 and 92 and apertures 84 and 94 be punched or molded first, that conductors 80 and 90 be placed in their proper locations next, and finally that the potted material in block 20 seals the interior 15 last. In this respect, apertures 86 and 87 are formed by the sealing material surrounding the already-placed conductors 80 and 90. Of course, in alternative embodiments, apertures 86 and 87 could just as easily be punched, molded or otherwise generated.

An advantage of the configuration shown in FIGS. 1 and 2 is that external circuitry (not limited to LED 96) may now be coupled to any part of the electrical circuit located on the PC board (not shown). The resulting assembly 5 is modular and expandable. All of the frequencies, currents, potentials and impedances within the PC board (not shown) that were heretofore inaccessible may now be accessed and utilized in any way known in the art.

Figure 3:
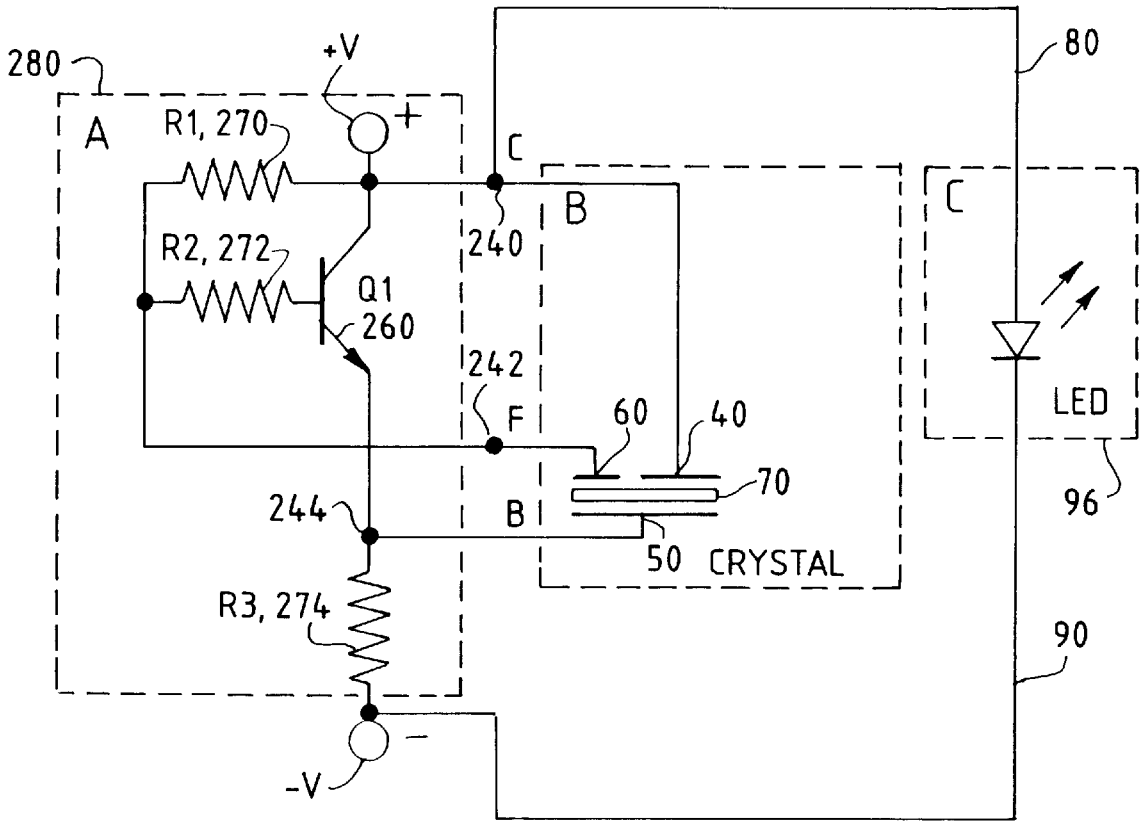
FIG. 3 shows an the audible and visible oscillator circuit of a preferred embodiment of the present invention.

FIG. 3 shows a circuit of a preferred embodiment of the present invention. In general, FIG. 3 shows a variation on the electrical noise providing circuit of U.S. Pat. No. 3,815,129 with a light producing illumination element 96 connected in parallel across +V and −V. LED 96 is the light producing element. LED 96 might be a self-blinking LED, or a standard LED. While an LED is preferred, any illumination device may be suitably used, such as incandescent bulbs, without departing from the scope of the disclosure. Resistors 270, 272 and 274 are resistors that bias transistor 260. These in general make up driving circuit 280, contained within the dotted lines of the figure. Transistor 260 is connected to +V, and also to −V through emitter resistor 274. Transducer 70 has three terminals, 40, 50 and 60 as described above.

In operation, the circuit works as follows. When a positive potential (an electrical signal) is applied to +V with −V connected to ground, transducer 70 vibrates at a predetermined frequency, as determined by the impedances in the oscillator circuit 280 and transducer 70, producing an audible signal. More specifically, initially transistor 260 is biased off. When the electrical signal appears at +V, the same potential appears at terminal 40. This causes the crystal in transducer 70 to deform. Simultaneously, the substrate to which the crystal is mechanically attached also deforms. The deformation causes the potential at terminal 60 to begin to rise. Eventually, the potential at terminal 60 rises sufficiently to forward bias transistor 260 into its on state through base resistor 272. When this happens, the potential at terminal 50 quickly rises to that at +V, diminished by an amount equal to $V_{CE}$ of transistor 260. It is well known that $V_{CE}$ of a bipolar junction transistor in saturation is approximately 0.3 volts; therefore, the potential at terminal 50 will now become (+V minus 0.3) while the potential at terminal 40 remains (+V). At this point, the deformation in the crystal of transducer 70 reverses. Consequently, the potential at terminal 60 now starts to decrease until transistor 260 is once again biased in the off position. The cycle repeats indefinitely. All the while, when a potential is applied to +V, LED 96 is excited and produces a visible signal. The signal may blink, as in the case where a blinking LED is used, or may be constant light, as in the case where a standard LED is used.

It will be appreciated that those skilled in the art may now make many uses and modifications of the specific embodiments described without departing from the inventive concepts. It is apparent that variations of the above embodiments may be easily performed. For example, LED 96 may be placed flush with the second external portion 34, enabling an audible and visual signaling device having a streamlined and attractive form factor. LED 96 may also be placed in the interior 15 of housing 10, as long as its visual signaling attributes are perceptible by an intended viewer, such as in an alarm situation. In this instance, housing 10 may be constructed from a clear material, such as LUCITE, glass or a transparent/translucent polymer. In another example, while a three terminal transducer has been shown, a two terminal transducer may be used without departing from the scope of the invention. In still another example, the modular features of the invention allow multiple audible and/or audible plus visual signaling devices to be chained together as a single apparatus. Other uses and modifications will be apparent.

We claim:

1. A piezoelectric transducer assembly comprising a housing defining an interior holding a piezoelectric transducer, the housing having a first exterior portion for attachment to a surface and a second exterior portion extending beyond the surface, wherein the first exterior portion and the second exterior portion comprise at least one pair of communicating apertures, and wherein the piezoelectric transducer has a sound producing diaphragm having at least one aperture operatively communicating with the at least one pair of communicating apertures, whereby an electrical conductor may extend through the at least one pair of apertures to the surface.

2. The assembly of claim 1 wherein the first and second exterior portions comprise a second pair of communicating apertures.

3. The assembly of claim 1 wherein a conductor extends through the at least one pair communicating apertures.

4. The assembly of claim 1 wherein a conductor extends through the at least one aperture and the at least one pair of communicating apertures.

5. The assembly of claims 3 or 4 wherein the conductor is attached at one end to an illumination element.

6. The assembly of claim 5 wherein the illumination element comprises an LED.

7. The assembly of claims 3 or 4 further comprising an electrical driving circuit for driving the piezoelectric transducer, the electrical circuit comprising a plurality of electrical components, wherein the conductor is attached at one end to one of the plurality of electrical components.

8. A piezoelectric transducer assembly having a housing defining an interior and a surface, the housing comprising at least one pair of communication aperatures at its surface and holding a piezoelectric transducer disposed within an electrical circuit, wherein the housing further comprises an illumination element associated with the surface thereof, the illumination element electrically coupled to one or more conductors which extend through the interior of the housing, and wherein the piezoelectric transducer has a sound producing diaphragm having at least one aperture operatively communicating with the at least one pair of communicating apertures, whereby the illumination element may be electrically inserted into the same electrical circuit as the piezoelectric transducer.

* * * * *